US005945616A

United States Patent [19]

Hoshino

[11] Patent Number: 5,945,616

[45] Date of Patent: Aug. 31, 1999

[54] GROUND SUPPORT FOR HIGH HAT STAND

[75] Inventor: Yoshihiro Hoshino, Nagoya, Japan

[73] Assignee: Hoshino Gakki Kabushiki Kaisha, Japan

[21] Appl. No.: 08/934,827

[22] Filed: Sep. 22, 1997

[30] Foreign Application Priority Data

Feb. 18, 1997 [JP] Japan ..... 9-050964

[51] Int. Cl.[6] ..... G10D 13/02

[52] U.S. Cl. ..... 84/422.3

[58] Field of Search ..... 84/422.3

[56] References Cited

U.S. PATENT DOCUMENTS 5,105,706 4/1992 Lombardi ..... 84/422.3

5,165,635 11/1992 Hoshino ..... 248/188.7

FOREIGN PATENT DOCUMENTS 1382432 1/1975 United Kingdom .

*Primary Examiner*—William M. Shoop, Jr.

*Assistant Examiner*—Shih-yung Hsieh

*Attorney, Agent, or Firm*—Odtrolenk, Faber, Gerb & Soffen

[57] ABSTRACT

A high hat stand has a lower support pipe and an upper pipe above the lower pipe and to which a fixed cymbal is attached. An upper movable cymbal is relatively movable with respect to the lower cymbal by an operating shaft that passes through the lower support pipe and is connected with a swingable foot pedal. Two pivotable legs are supported to the pipe. Together with the foot pedal support body, the two legs support the lower pipe. The pivot orientation of the legs determines the tilt of the pipe. The pedal is connected with a support and a ground member on the support, the ground member being movable outward from the lower pipe for establishing, along with a position of the legs, the tilt orientation of the lower pipe and the high hat stand.

9 Claims, 14 Drawing Sheets

GROUND SUPPORT FOR HIGH HAT STAND

BACKGROUND OF THE INVENTION

The present invention relates to a high hat stand and particularly to the ground support for the stand.

In a high hat stand, an upper vertically movable cymbal is movable by pedal operation up or down with respect to a fixed lower cymbal.

Most high hat stands have a pipe stand that is supported by three stand legs. U.S. Pat. No. 5,105,706 discloses a high hat stand having such a structure, but with the pipe stand supported by the support frame of the foot pedal cooperating with two stand legs. This proposed structure has the advantage of reducing the number of stand legs from three to two. This enables the performer to clear the foot area of the stand, freeing him to concentrate on a fine performance.

For a drum set employing a twin pedal, two bass drum pedals are arranged near the foot of the performer in addition to the pedal of the high hat stand. In addition, the high hat stand has three stand legs, making it inevitable for the foot of the performer to contact a stand leg. There is a great advantage to reducing the number of the stand legs to two.

Meanwhile, it is sometimes desired to move the cymbal part of the high hat stand closer to the performer or to some other musical instrument, such as the snare drum. To satisfy this requirement, the present applicant had proposed a bent inclined motion structure for the pipe stand which is described in Japanese Utility Model No. Sho 60-169692 or Utility Model No. Hie 1-36236. In particular, one of the pipes of the stand is hinged along its length, enabling the pipe to be bent to incline the high hat toward the performer. This stand retains three legs at least one of which is likely to be in the foot area of the performer.

In this kind of high hat stands, clearing the foot area of the performer and inclining the cymbal part have been strong demands from performers.

SUMMARY OF THE INVENTION

It is an object of the present invention to provide a new structure for high hat stand, wherein the area surrounding the performer's feet can be cleared.

Another object is to be able to incline the supported stand.

These objects are achieved by reducing the number of the stand legs to two. It is easier to incline the cymbal part through a two-leg structure of the stand.

The high hat stand of the invention includes an upper pipe with an operating shaft inserted and movable through it. A cymbal part comprises a fixed lower cymbal fixed to the top of the upper pipe and a movable upper cymbal held on the operating shaft to be moved to or separated from the fixed lower cymbal. A lower pipe holds the upper pipe.

A leg part comprises two stand legs that are held to the lower pipe so as to be movable up and down and to be or to be mounted to rotate freely around the lower pipe through an annular shaped holding member for the legs being rotatably positionable around the pipe. A support frame supports the lower part of the lower pipe. That frame has a grounding member at the bottom of a main gate-shaped body. A foot operated pedal includes a heel that is arranged inside the gate-shaped main body of the support frame. That body touches the foot pedal and the floor plate. The heel of the pedal and the main gate-shaped body of the support frame are linked by a link arm at an adjustable angle.

Other objects and features of this invention are explained below with reference to the drawings.

DESCRIPTION OF PREFERRED EMBODIMENTS OF THE INVENTION

Figure 1:
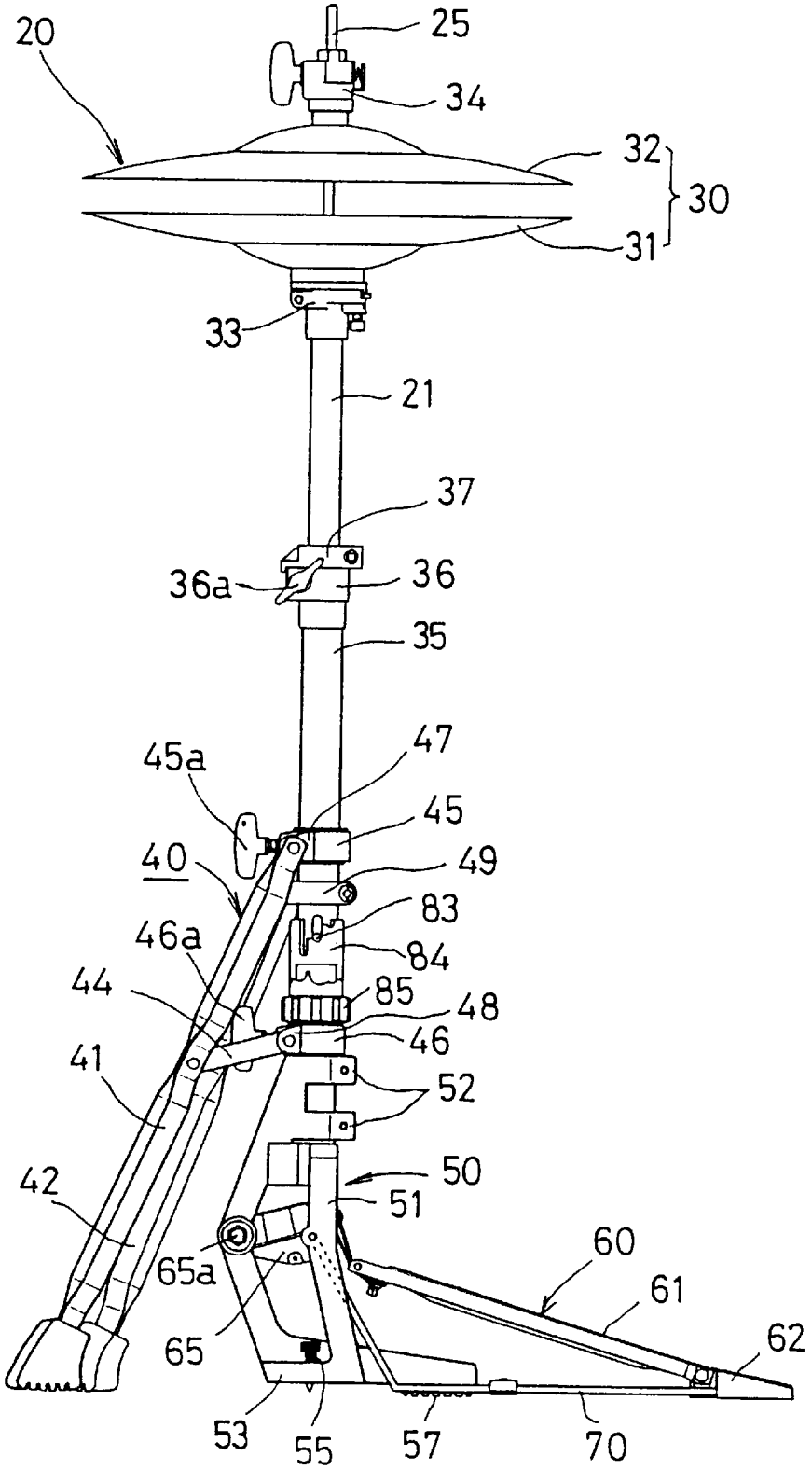
FIG. 1 is a side view of a high hat stand according to the invention.
Figure 2:
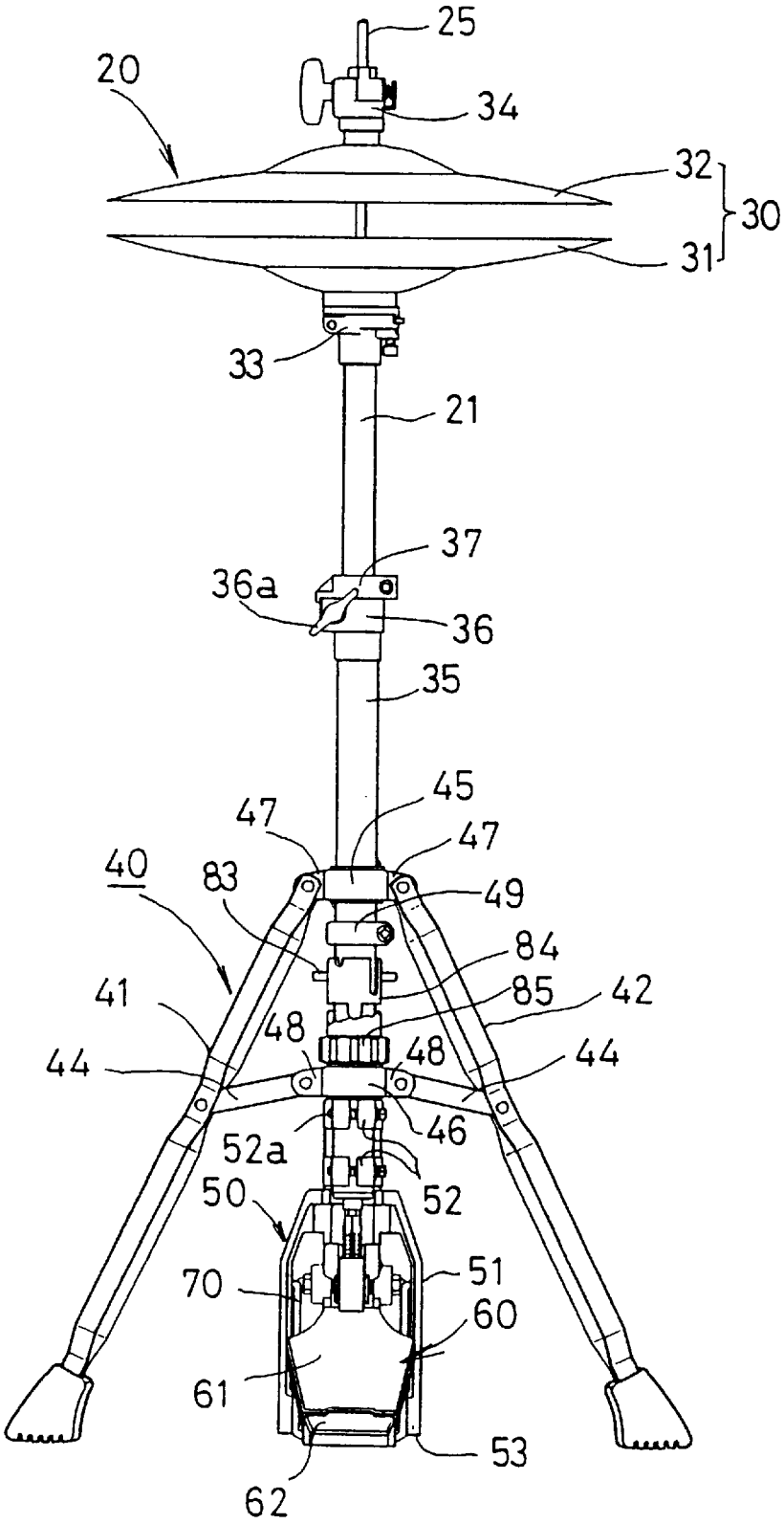
FIG. 2 is a front view thereof.

The high hat stand in FIGS. 1 and 2 comprises an upper pipe 21, a cymbal part 30, a lower pipe 35, a leg part 40, a support frame 50, a pedal 60 and a linkage arm 70.

The upper pipe 21 is at the top of the high hat stand 20. A movable operating shaft 25 runs through the pipe 21. The operating shaft 25 is connected to a pedal 60, and the shaft 25 is moved up and down through operation of a foot pedal 61.

The cymbal part 30 comprises a fixed lower cymbal 31, which is fixed to the top of the upper pipe 21 and a movable upper cymbal 32, which is held by the operating shaft 25 to be freely moved against or separated from the lower fixed cymbal 31. An installation part 33 fixes the fixed lower cymbal 31 to the upper pipe 21, and an installation part 34 fixes the movable upper cymbal 32 to the operating shaft 25.

A lower pipe 35 supports the upper pipe 21. The upper pipe 21 passes through the lower pipe 35, and is tightly fixed in height along the pipe 35 by tightening means 36, including a tightening bolt 36*a*. A memory lock 37 is fixed to the upper pipe 21 and as the pipe 21 is moved to cause the lock 37 to contact the tightening member 36, it fixes (memorizes) the height of the upper pipe 21 and also reinforces the tightening means.

The leg portion 40 comprises two stand legs 41 and 42 which are held to the lower pipe 35 to both be movable up and down along the pipe 35 and to freely rotate around the pipe 35. The legs 41 and 42 are attached by the annular holding member 45 at the top end and member 46 toward the middle of the legs. The annular holding members 45 and 46 are arranged above and below along the lower pipe 35 and are tightly or loosely attached to the lower pipe 35 by means of tightening bolts 45*a* and 46*a*, respectively. The annular holding members 45 and 46 are movable up and down and freely rotatable with respect to the lower pipe 35 when they are not secured by the bolts 45*a* and 46*a*.

The annular holding members 45 and 46 include integral flanges 47 and 48 for axially supporting the two stand legs 41 and 42. In FIG. 2, the two stand legs 41 and 42 are directly installed on the flanges 47 at the upper annular shaped holding member 45 and are installed though the links 44 on the flanges 48 at the lower annular holding member 46 at the middle region of the legs.

Pins link the stand legs 41 and 42, the flanges 47 and 48 and the links 44.

The two stand legs 41 and 42 are installed at an angular distance apart around the leg 35 of approximately 120 degrees.

A memory lock 49 stores the installation position of the upper annular holding member 45 by being affixed to pipe 35 at a selected height. It is convenient in deciding the inclined position described below.

The support frame 50 supports the lower part of the lower pipe 35. The frame has a grounding member 57 at the bottom 53 of its main gate shaped body 51.

In FIGS. 1 and 2, the support frame 50 has a lower pipe holding part 52 that is integrally formed at the top of the main body 51. The holding part 52 is tightened by a bolt 52*a* to support the bottom of the lower pipe 35.

Figure 7:
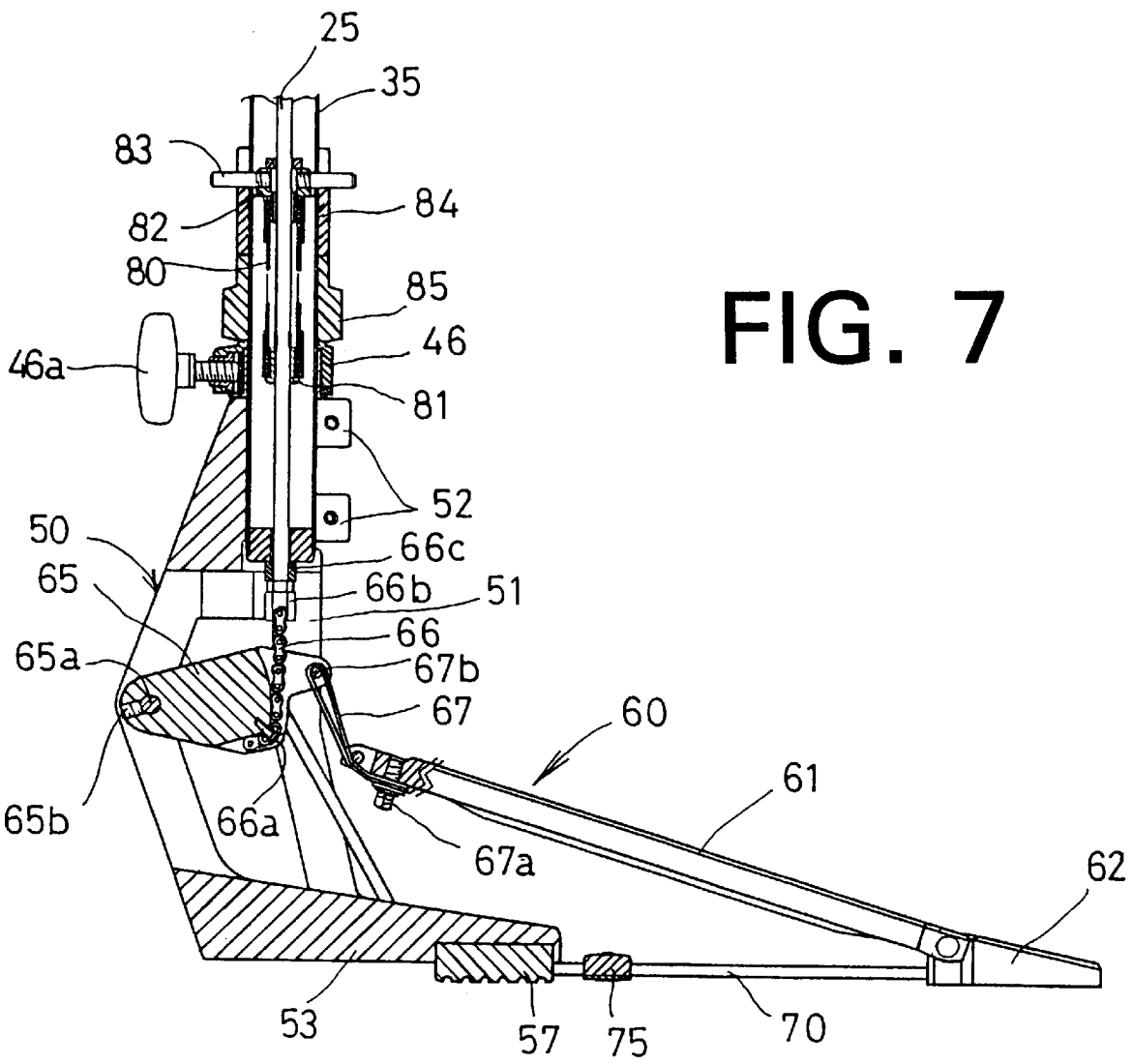
FIG. 7 is a cross section of essential parts and showing the support frame, the pedal and the linkage arm of FIG. 1.
Figure 8:
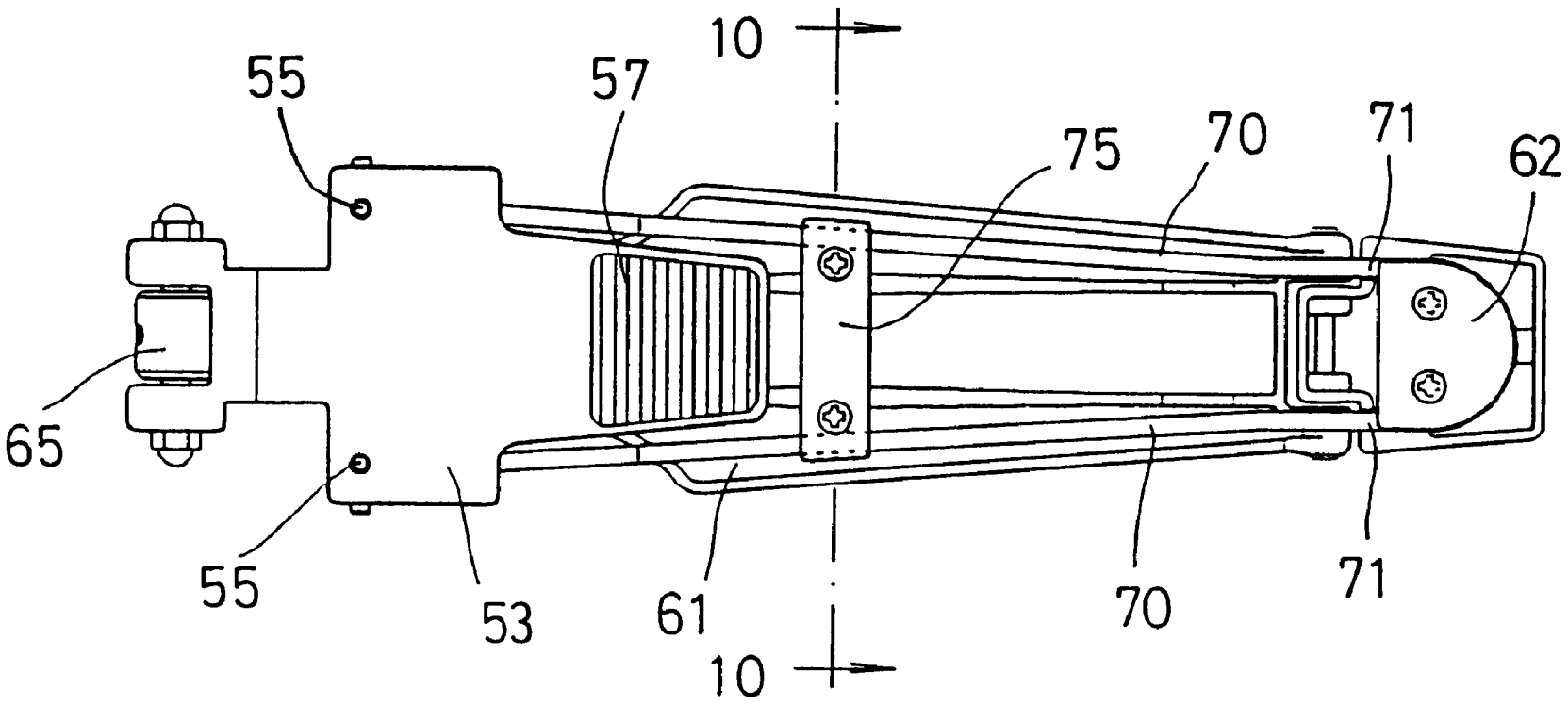
FIG. 8 shows the bottom of FIG. 7.

The grounding member 57 at the bottom 53 of the main gate shaped body 51 is shown in FIGS. 7 and 8. The member 57 grounds the support frame 50 in a stable manner. It includes a rubber plate, etc., with non-skid surface or texture.

A spike bolt 55 is screwed in at the right and left sides of the bottom 53. It may be hooked to the floor at the tip of the bolts 55 to prevent movement, called walking, of the stand due to vibrations, etc. during the course of the performance. It is extended or withdrawn according to the incline of the main gate shaped body 51.

The pedal 60 is arranged inside the main gate shaped body 51 of the support frame 50. It comprises a foot pedal 61, which is pivotally linked to and that moves the operating shaft 25 up and down, and a heel 62 that is linked to the floor plate. The basic mechanism of the pedal 60 is known. One example is shown in cross section in FIG. 7. The rotary motion member 65 that has been supported by the main gate shaped body 51 of the support frame 50 is rotated by the vertical movement of the foot pedal 61 and the operating shaft 25 is moved up and down through such a linkage member 66 as a chain, etc. that has been fixed to the rotary motion member 65.

A connective member 67 connects the foot pedal 61 and the rotary motion member 65. A stopper screw 67*a* fixes the connective member 67 to the foot pedal 61. A stopping part 67*b* is positioned on the side of the rotation motion member 65 of the connective member 67. The rotary motion member 65 has a rotary shaft 65*a* with a stopper screw 65*b*. A stopper screw 66*a* fixes the linking member 66 to the rotary motion member 65. There is an operating shaft fixing part 66*b* of the linkage member 66, including stopper member 66*c*.

Figure 11:
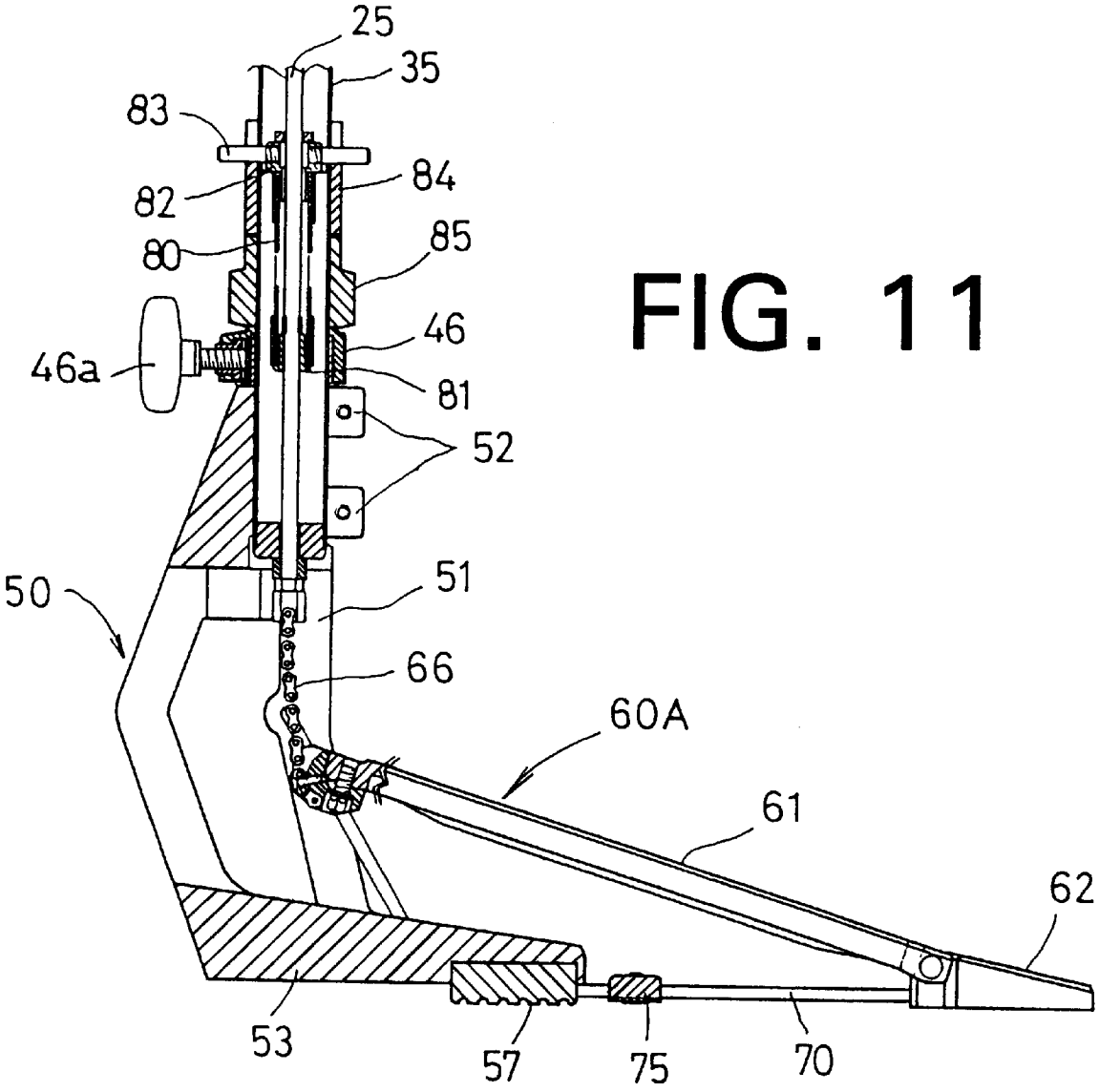
FIG. 11 is a cross section of the essential part showing another embodiment of the invention.

FIG. 11 shows a pedal 60A, which uses no rotary motion member. Numbers used in FIG. 7 indicate common parts.

A mechanism for adjusting the spring tension of the foot pedal 61 is shown at the tops of FIGS. 7 and 11. A coil spring 80 is held by a holding member 81 that holds the bottom of a spring for fixing the lower end of the spring to the operating shaft 25. A holding member 82 holds the top end of the spring. An engaging bar 83 is integral with the spring top end holding member. An upper side tension adjustment member 84 is fixed to the lower pipe 35 for holding the height of the engaging bar 83 at a freely adjustable height. A lower tension adjustment member 85 is fixed to the lower pipe 35 for holding the upper side tension adjustment member 84 at a freely adjustable height.

Through rotation of the upper side tension adjustment member 84 and the lower side tension adjustment member 85 (more easily understood in the appropriate part in FIG. 2), the height or length of the spring 80 fixed to the bottom of the operating shaft 25 changes, and the tension (or weight) of the foot pedal 61 that operates the operating shaft 25 also changes.

FIGS. 12, 13, 14 and 15 show a grounding member with a slidable construction. The grounding member 57A is integrally equipped with a slider 59 that slides along a sliding groove 58 at the bottom 53 of the main body 51 of the support frame 50.

Figure 12:
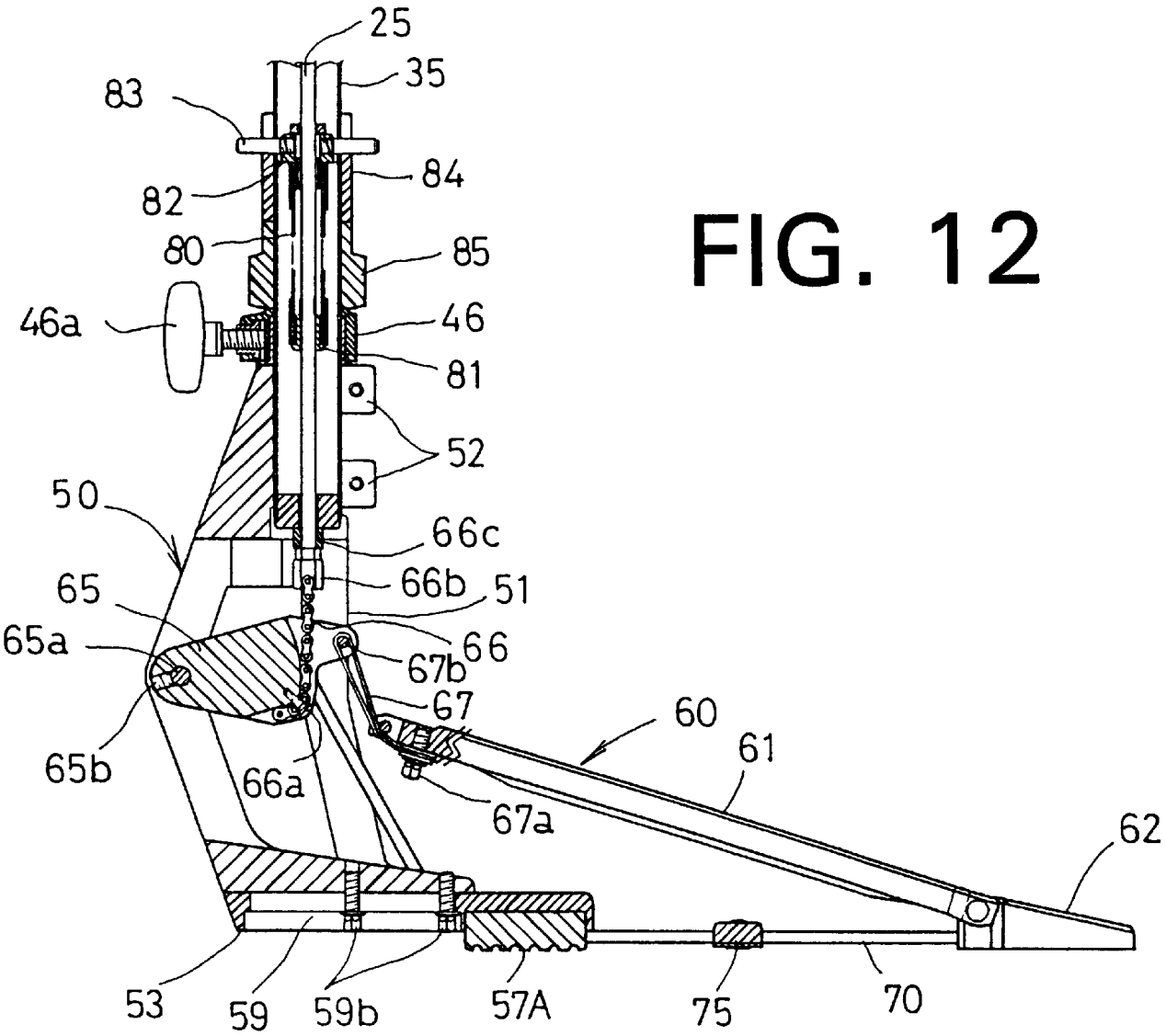
FIG. 12 is a cross section of the essential part showing an embodiment having a slidable grounding.
Figure 13:
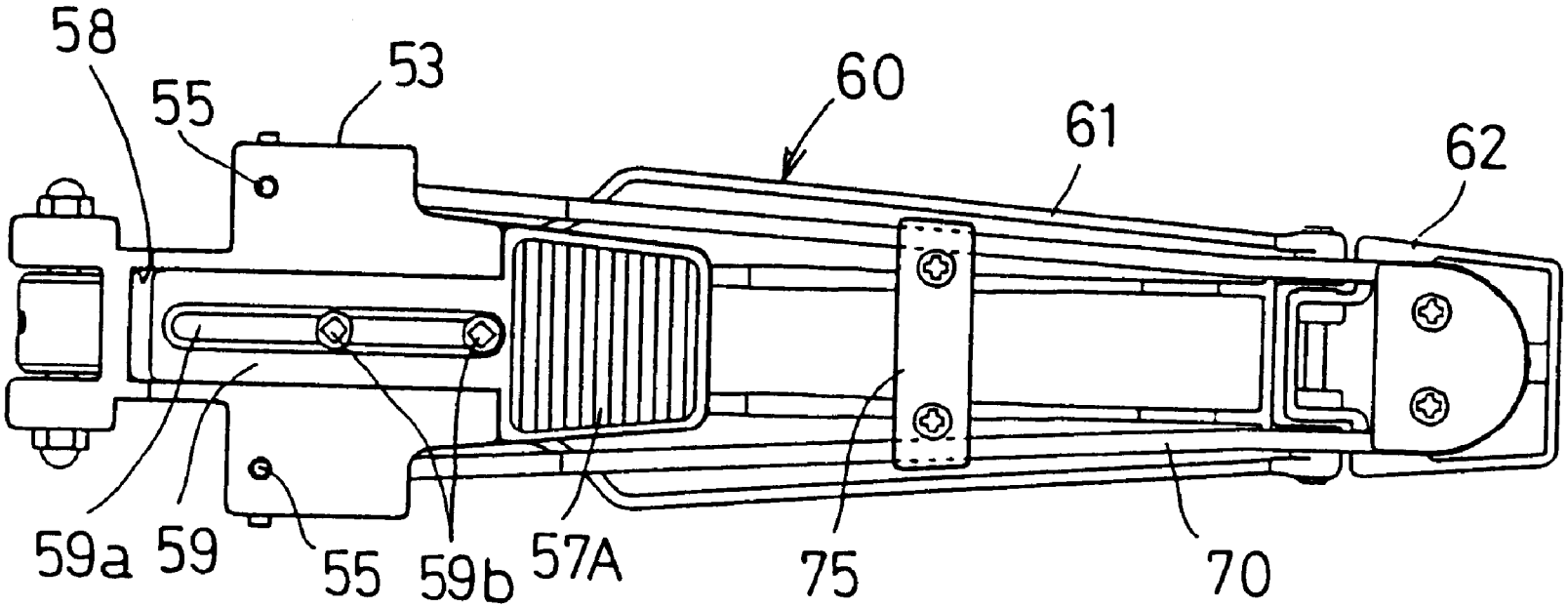
FIG. 13 shows the bottom of the part.
Figure 14:
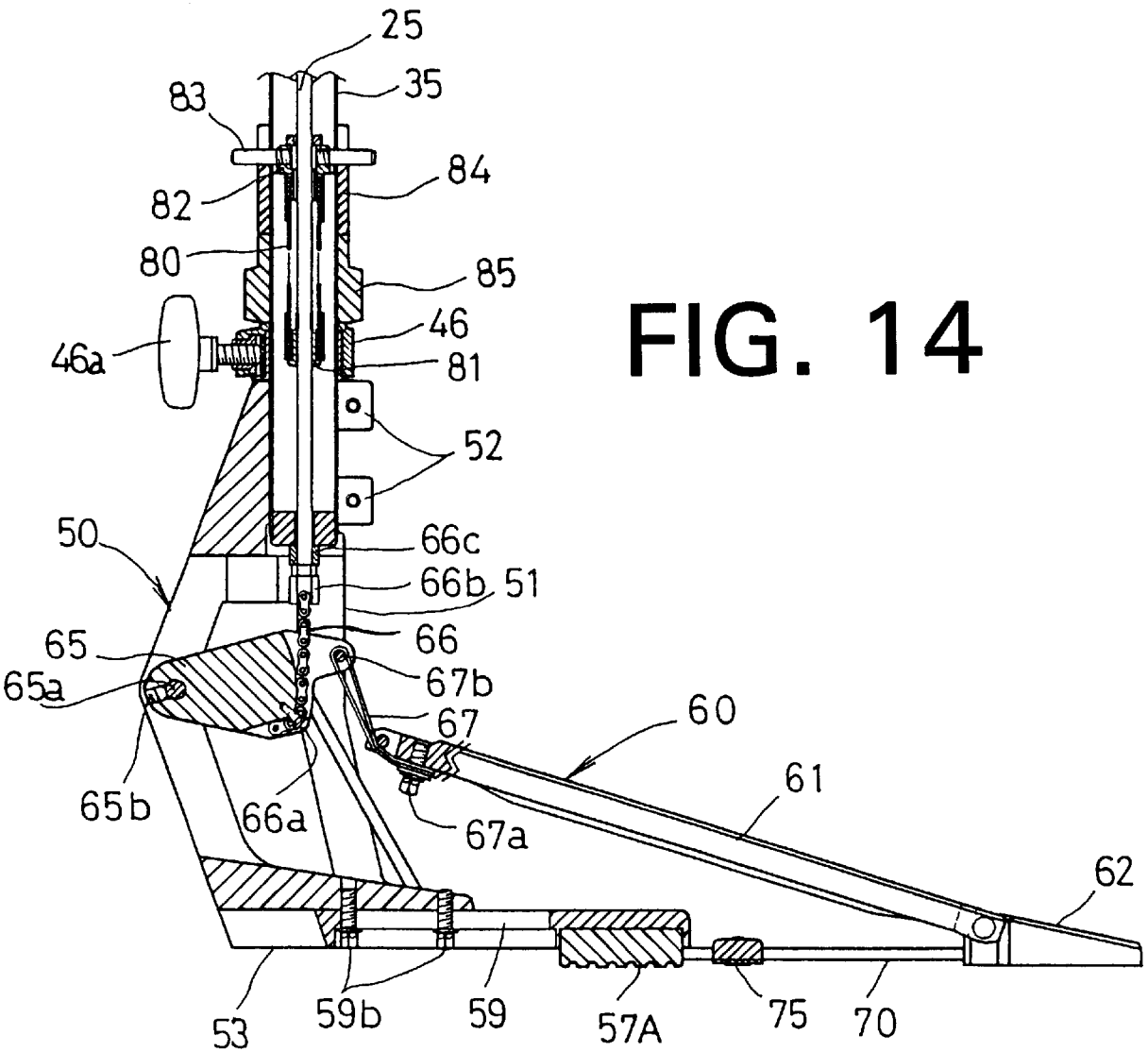
FIG. 14 is a cross section showing the state in which the grounding member has been stretched.
Figure 15:
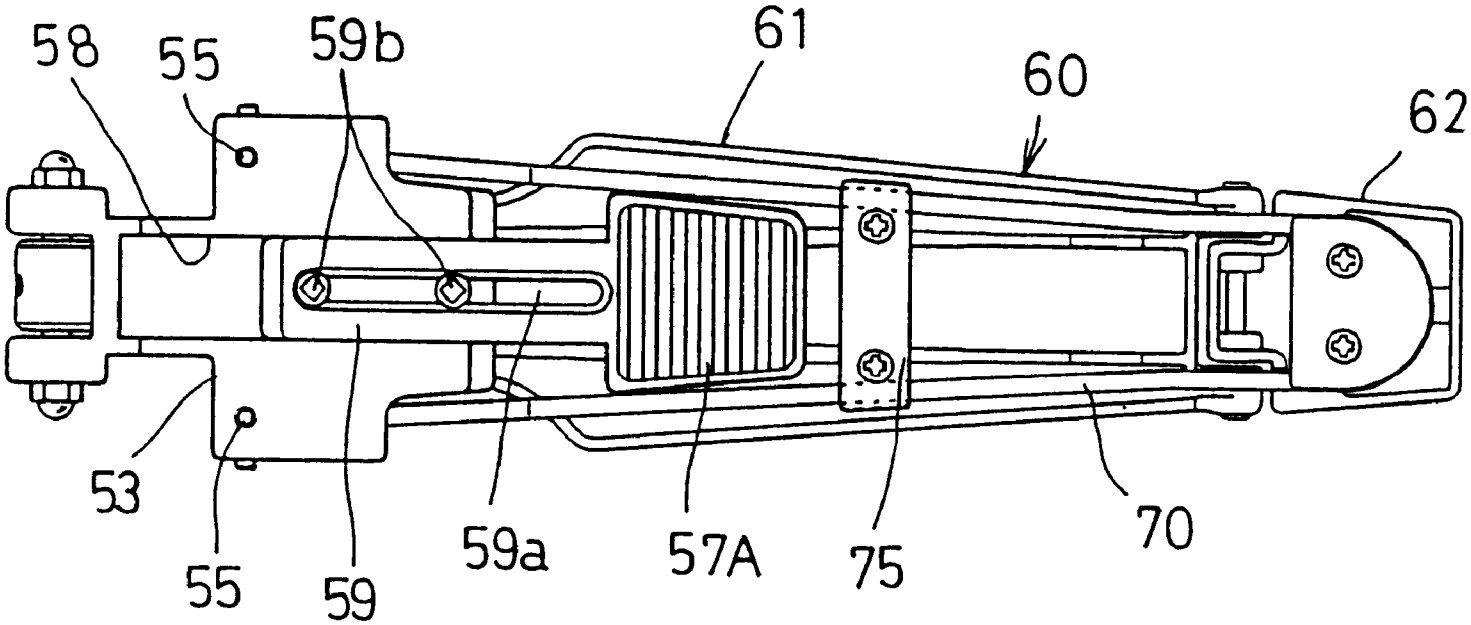
FIG. 15 shows the bottom of that part.

As the slider 59 is slidable to the right in FIGS. 12 and 14 along the sliding groove 58, the grounding member 57A separates from the bottom (refer to FIGS. 14 and 15) increasing the stability of the stand. The slider includes an adjusting groove engaging part 59*a*. A fixed bolt 59*b* sets the greatest outward movement.

The link arm 70 links a heel 62 of the pedal 60 and the main body 51 of the support frame 50 at a freely adjusted angle.

Figure 9:
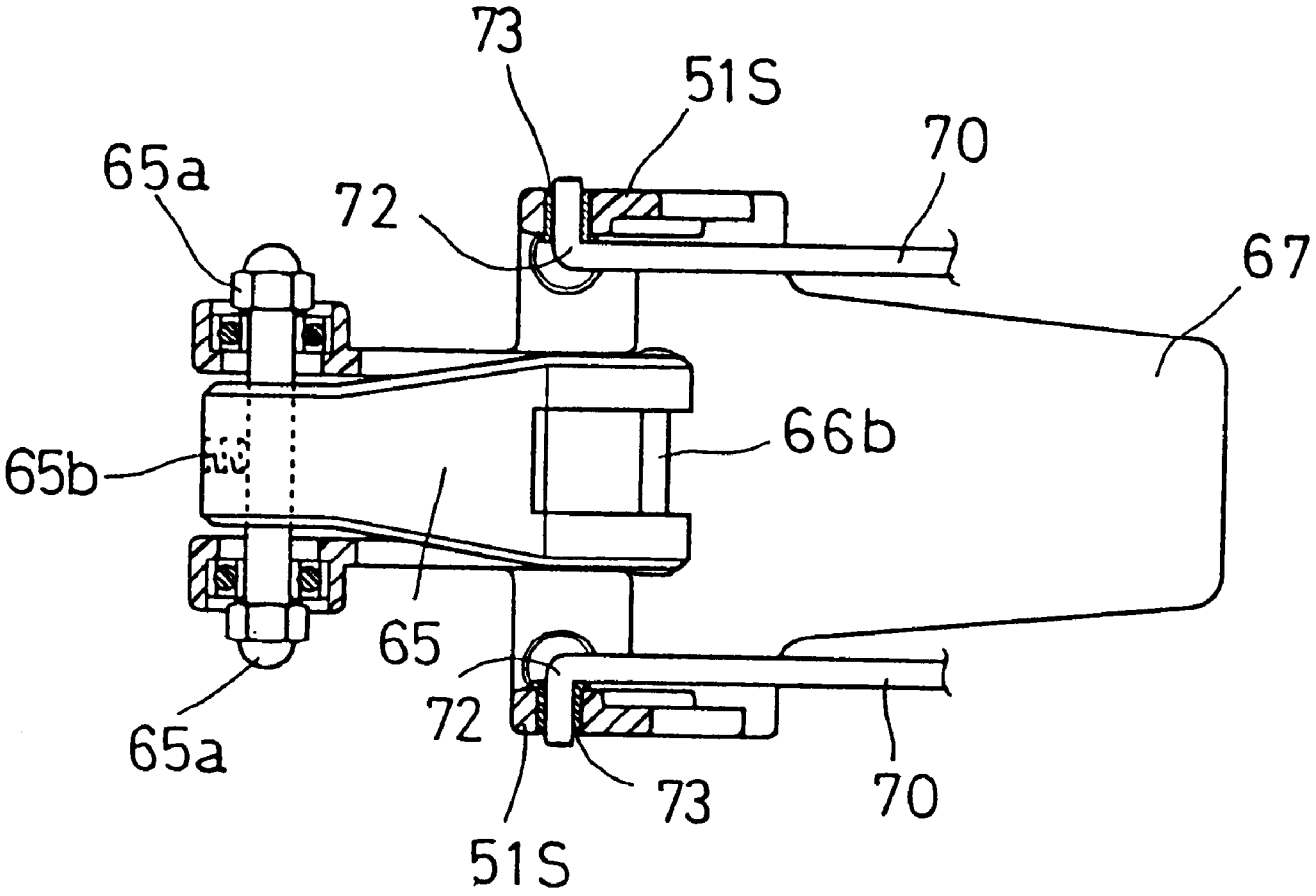
FIG. 9 is a cross section showing the rotary movement part of the linkage arm.
Figure 10:
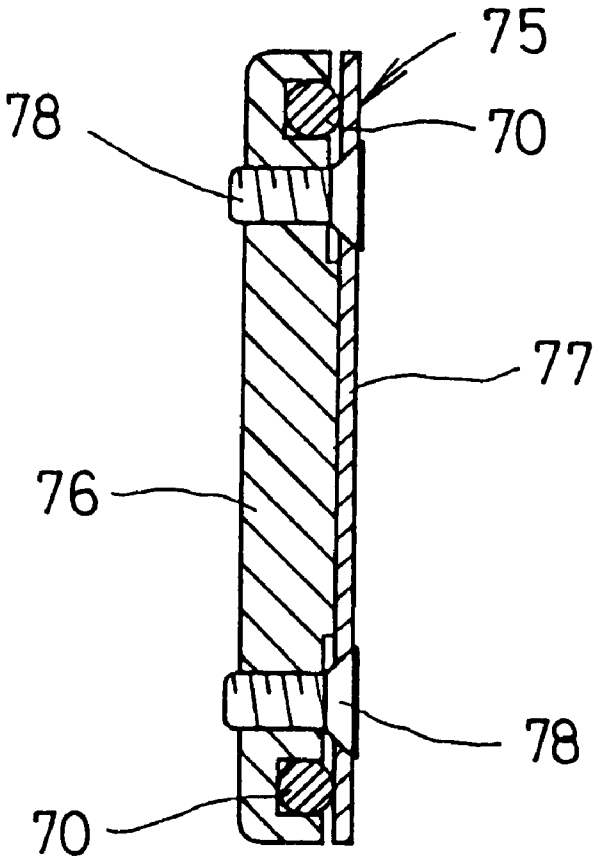
FIG. 10 is a cross section of the reinforcement member on line 10—10 in FIG. 8.

As shown in FIGS. 7 and 8, the link 70 is a metal bar bent approximately in the shape of an L. Two links are arranged to the right and to the left. The rear end 71 of the link 70 is fixed to the heel 62 of the pedal 60, while the front end 72 is freely rotatably journaled on the side pillar part 51S of the main gate-shaped body 51 of the support frame 50 through a nylon bushing 73, as shown in FIG. 9. As the front end of the linkage are 70 is journaled to the support frame 50 in a freely rotatable manner, it is linked with the heel 62 at a freely adjusted angle.

As the front edge 72 of the link 70 is journaled through the nylon bushing 73, moreover, it is easy to replace the parts at the time when the rotary part has been worn and thus prevent a squeaking sound from being generated during a performance.

A reinforcement linkage member 75 for the two links 70 comprises a receiving member 76, a holding member 77 and a stopper screw 78.

The action of the high hat stand of the invention is explained below.

As shown in FIGS. 1 and 2, the high hat stand is supported by the two stand legs 41 and 42 and by the bottom 53 of the support frame 50. In an ordinary erect state of the stand, the bottom 53 of the support frame 50 maybe positioned between the two stand legs 41 and 42. (See FIG. 4.)

Since the leg part 40 which includes the stand legs 41 and 42 is held freely rotatably on the lower pipe 35, moreover, it is possible to shift the stand legs 41 and 42 to one side, as a performer or the necessity of an arrangement with the other foot pedals may demand. See FIG. 5.

Figure 3:
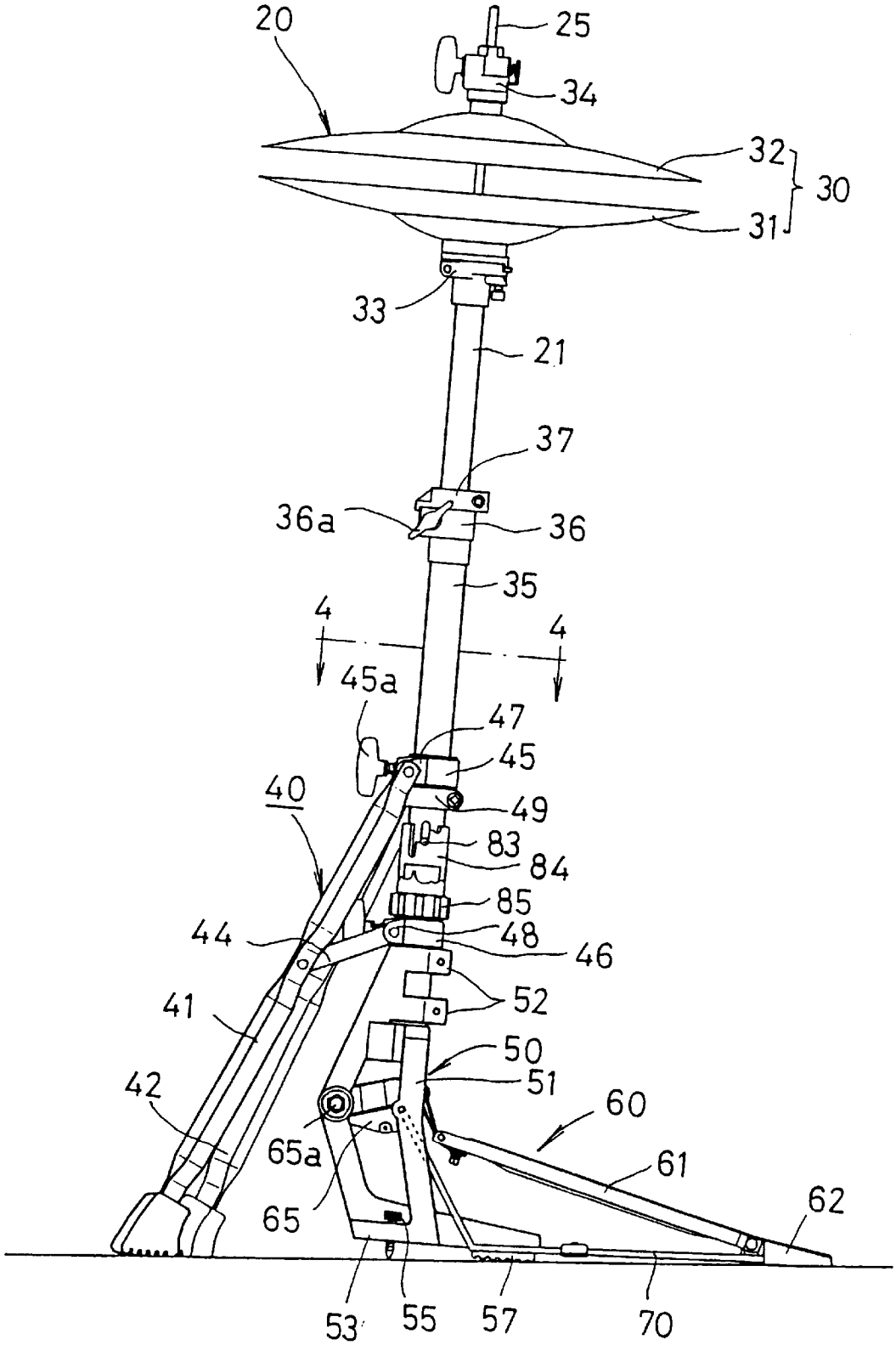
FIG. 3 is a side view of the entire structure showing the high hat stand inclined.
Figure 4:
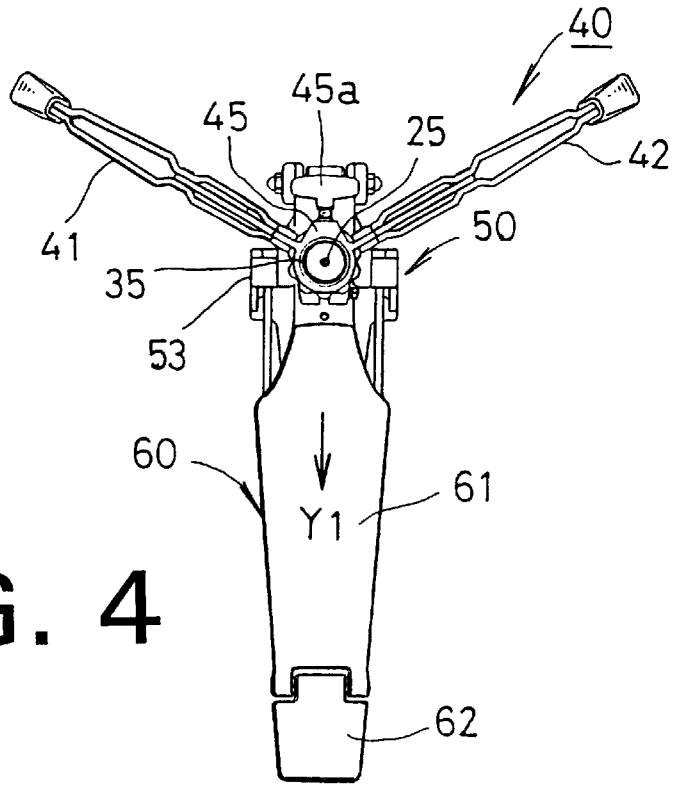
FIG. 4 is a cross section along line 4—4 in FIG. 3.

When the cymbal part 30 is to be drawn closer to the side of the performer (Y1 in FIG. 4), the upper annular holding member 45 of the leg part 40 is bent downward, as shown in FIGS. 3 and 4, thereby tilting the lower pipe 35 to the side of the foot pedal 61 or on the side of the performer (arrow mark Y1).

Figure 5:
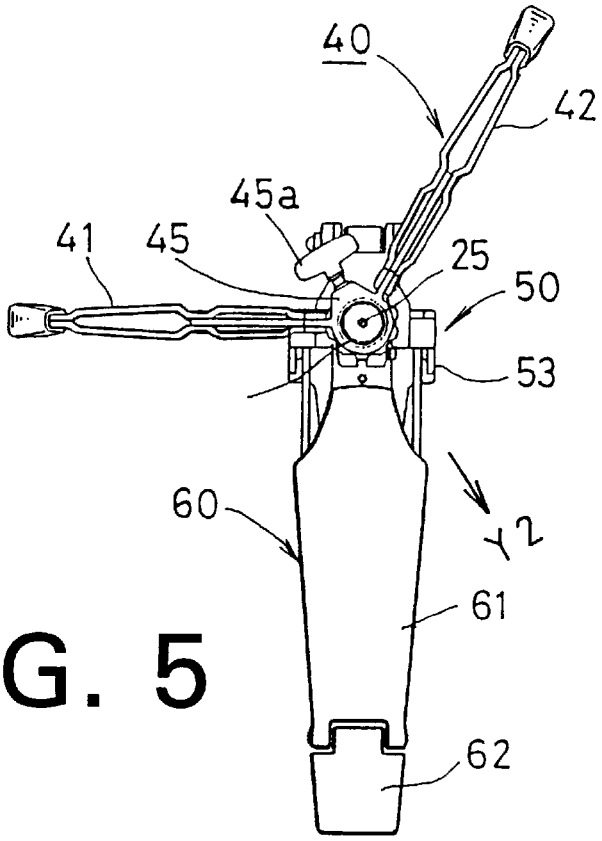
FIG. 5 is the same cross section showing the legs rotated from their orientation of FIG. 4.

To bring the cymbal part 30 closer to a side other than the side of the performer (Y2 in FIG. 5), it is only necessary to rotate the annular holding member 45 of the leg part 40 for the adjustment. FIG. 5 shows the leg part 40 rotated counterclockwise and in the inclined motion state shown in FIG. 4. In this case, the inclined direction of the lower pipe 35 is toward the arrow mark Y2 side shown in FIG. 5.

Figure 6:
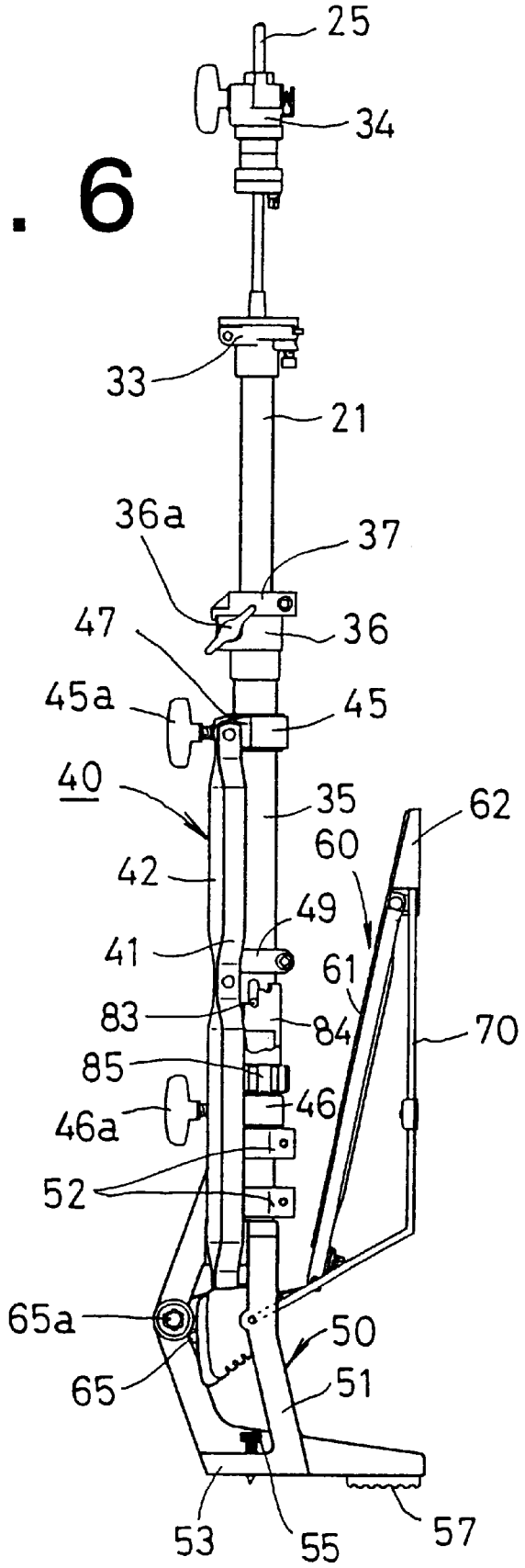
FIG. 6 is a side view of the entire body, showing the state in which the legs and the arm member have been folded.

FIG. 6 shows high hat stand folded after removal of the cymbal 30. It can be folded compactly. This is highly convenient for storage and transportation.

According to the invention, the number of the stand legs is reduced to two, thereby clearing the area around the performer's legs, and tilting of the cymbal part can be carried out easily by utilizing the two-leg structure of the stand leg, thereby meeting the requirements of performers.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high hat stand comprising:

a support for a fixed cymbal comprising a lower pipe supporting the fixed cymbal;

a shaft extending along and movable along the lower pipe;

an upper cymbal connected on the shaft for being moved by movement of the shaft with respect to the lower pipe;

a pedal, and a connection between the pedal and the shaft, so that movement of the pedal moves the shaft; the pedal having a heel away from the connection to the shaft and the pedal being pivotable at the heel as the pedal is moved to move the shaft and the cymbal thereto attached;

a leg part for supporting the lower pipe, the leg part including a holding member held to the lower pipe to be movable up and down along the lower pipe and to rotate around the lower pipe, the holding member being fastenable at an adjusted location with respect to the lower pipe;

two support legs attached to the holding member and positionable at an incline with respect to the holding member, whereby the lower pipe is adjustable to different degrees of incline with respect to the holding member of the lower pipe and the support legs are adjustable to different positions around the lower pipe;

a ground member that supports the pedal and the lower pipe, the ground member defining a support for the lower pipe in addition to the legs; the heel of the pedal being attached to the ground member and the pedal being pivotable with reference to the ground member as the pedal is moved to move the operating shaft, wherein the two legs can both be pivoted together to different extents outward from the lower pipe, and the ground member can be moved to different positions spaced different distances away from the lower pipe, whereby the positions of the ground member with reference of the lower pipe and the orientation of the legs with reference of the lower pipe determines the tilt of the lower pipe and of the cymbals.

2. The high stand of claim 1, wherein the legs are pivotally supported to the holding member and are pivotable to different inclinations with respect to the holding member, for supporting the stand at different tilt orientations with reference to a ground.

3. The high hat stand of claim 1, wherein the holding member is an annular member around the lower pipe.

4. The high hat stand of claim 1, wherein the support for the fixed cymbal comprises an upper pipe held by the lower pipe and being above the lower pipe, the upper pipe being movable along the lower pipe for setting the height of the stand;

the movable cymbal being above the fixed cymbal and being connected with the shaft for being moved by the shaft toward and away from the fixed cymbal.

5. A high hat stand comprising:

a support for a fixed cymbal comprising a lower pipe supporting the fixed cymbal;

a shaft extending along and movable along the lower pipe;

an upper cymbal connected on the shaft for being moved by movement of the shaft with respect to the lower pipe;

a pedal, and a connection between the pedal and the shaft, so that movement of the pedal moves the shaft; the pedal having a heel away from the connection to the shaft and the pedal being pivotable at the heel as the pedal is moved to move the shaft and the cymbal thereto attached;

a leg part for supporting the lower pipe, the leg part including a holding member held to the lower pipe to be movable up and down along the lower pipe and to rotate around the lower pipe, the holding member being fastenable at an adjusted location with respect to the lower pipe;

two support legs attached to the holding member and positionable at an incline with respect to the lower pipe, whereby the lower pipe is adjustable to different degrees of incline with respect to the ground, and the support legs are adjustable to different positions around the lower pipe;

a ground member that supports the pedal and the lower pipe; the ground member being oriented and extending to lie flat on the ground; the heel of the pedal being attached to the ground member and the pedal being pivotable with reference to the ground member as the pedal is moved to move the operating shaft, the ground member being pivotably attached to the support at a pivot point of the ground member, whereby when the high hat stand in is use, the ground member remains flat on the ground as the support and the lower pipe are adjusted to different inclines.

6. The high hat stand of claim 5, wherein the two legs can be pivoted to different extents outward from the lower pipe, and the ground member can be moved to different positions spaced different distances away from the lower pipe, whereby the positions of the ground member with reference of the lower pipe and the orientation of the legs with reference of the lower pipe determines the tilt of the lower pipe and of the cymbals.

7. The high stand of claim 6, wherein the legs are pivotally supported to the holding member and are pivotable to different inclinations with respect to the holding member, for supporting the stand at different tilt orientations with reference to the ground.

8. The high hat stand of claim 5, wherein the holding member is an annular member around the lower pipe.

9. The high hat stand of claim 5, wherein the support for the fixed cymbal comprises an upper pipe held by the lower pipe and being above the lower pipe, the upper pipe being movable along the lower pipe for setting the height of the stand;

the movable cymbal being above the fixed cymbal and being connected with the shaft for being moved by the shaft toward and away from the fixed cymbal.

* * * * *